United States Patent [19]

Stoody

[11] 4,211,344

[45] Jul. 8, 1980

[54] SACK RETENTION AND PRESSURIZING FOR AEROSOL TYPE DISPENSERS

[76] Inventor: William R. Stoody, 5008 County Line, New Haven, Mich. 48048

[21] Appl. No.: 928,056

[22] Filed: Jul. 26, 1978

[51] Int. Cl.[2] ..... B67D 5/60

[52] U.S. Cl. ..... 222/131; 141/20; 222/386.5; 222/402.16

[58] Field of Search ..... 222/94, 95, 105, 107, 222/183, 386.5, 387, 389, 402.16, 402.21–402.23; 239/323; 141/3, 20

[56] References Cited

U.S. PATENT DOCUMENTS

| | | | |
|---|---|---|---|
| 2,816,691 | 12/1957 | Ward | 222/386.5 X |
| 2,898,012 | 8/1959 | Galeazzi | 222/402.1 |
| 3,241,722 | 3/1966 | Nissen | 222/386.5 X |
| 3,421,698 | 1/1969 | Baltzer | 239/323 |
| 3,477,195 | 11/1969 | Chambers | 222/394 X |
| 3,718,236 | 2/1973 | Reyner et al. | 222/386.5 |
| 3,731,854 | 5/1973 | Casey | 239/304 X |

*Primary Examiner*—David A. Scherbel
*Assistant Examiner*—Fred A. Silverberg
*Attorney, Agent, or Firm*—Cullen, Sloman, Cantor, Grauer, Scott & Rutherford

[57] ABSTRACT

In an aerosol type container having a pressure chamber, a product containment sack of an impervious flexible material is centrally retained. The aerosol container is provided with an annular opening defined by an annular lid curl. The lid curl is interlockingly engaged by a collar portion of the sack. A modified valve assembly is sealingly secured within a neck protruding from the sack collar. The sack collar acts as a one-way valve allowing a pressurizing agent to be introduced for the purpose of maintaining a desirable pressure within the container pressure chamber. The invention pertains to pressurizing, sealing and sack retainment of such dispensers.

22 Claims, 10 Drawing Figures

FIG. 9
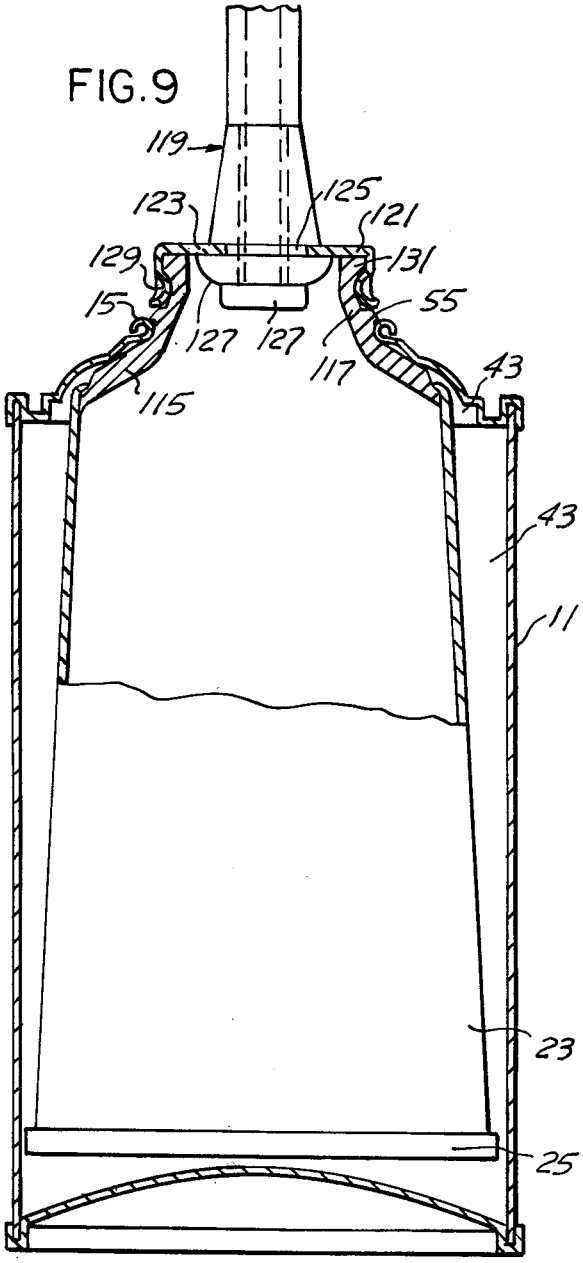
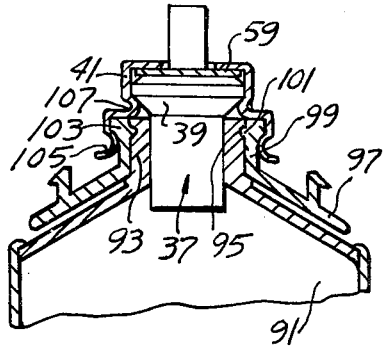
FIG. 6
FIG. 7
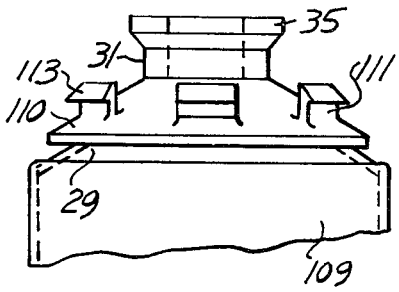
FIG. 8
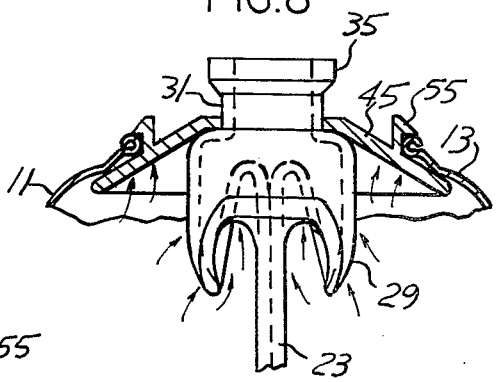
FIG. 10
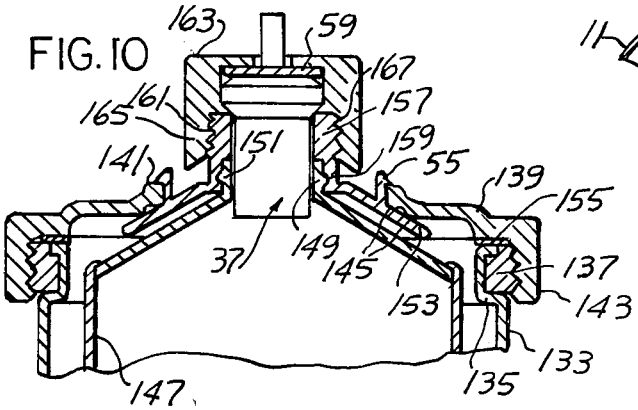

SACK RETENTION AND PRESSURIZING FOR AEROSOL TYPE DISPENSERS

RELATED APPLICATIONS

The present invention represents a modification to the pressurized dispensers in the applicant's co-pending patent application, Ser. No. 781,784 filed Mar. 28, 1977, now abandoned, application, Ser. No. 860,354 filed Dec. 14, 1977 now U.S. Pat. No. 4,159,789 and application, Ser. No. 887,580 filed Mar. 17, 1978 allowed July 20, 1979.

BACKGROUND OF THE INVENTION

Heretofore, the economics of sack contained aerosols have been compromised by restrictions dictated by the least needed feature of a sack contained aerosol, said feature being the valve assembly retainment and sealing flange. Said flange is constructed to be mechanically and sealingly interlocked with the annular opening in the top of an aerosol can, fulfilling a necessary requirement for aerosols not provided with a product sack.

Three basic restrictions imposed on sack contained aerosols are filling, pressurizing and sack retainment. In existing art, at least one of the said restrictions is not satisfied in an economically feasible manner. Plugs are added for pressurizing, sacks are filled through valve stems and sack retainment relies on the valve assembly.

The applicant's U.S. Pat. No. 4,159,789 while recognizing permissive modifications to valve assemblies, neglected to utilize the sack for the introduction of the pressurizing agent and relied on the costly addition of a self-sealing plug.

The applicant's last co-pending application, Ser. No. 887,580, introduced a sack retainer. The sack retainer seemingly satisfied all said restrictions imposed by the valve assembly retainment and sealing flange. However, it, too, is an unnecessary cost item; and product overfill has a tendency of entering the pressure chamber portion of the container.

Other dispensers in the art having a collapsible sack are shown in the following United States Patents:

| PATENT NO. | INVENTOR |
|---|---|
| 3,549,058 | E. J. Bolk |
| 3,477,195 | C. D. Chambers |
| 2,816,691 | L. T. Ward |
| 3,731,854 | D. E. Casey |
| 3,169,670 | P. Hrebernak & L. Zuckerman |

None of the referenced patents economically satisfy all of the said imposed restrictions.

This invention is particularly suited for squeeze tube product containment sacks as described in the applicant's co-pending application, Ser. No. 887,580. However, it is fully recognized to have a broad application suitable for adaptation to all product containment sacks of said art. Therefore, this application is directed to a preferred embodiment.

SUMMARY OF THE INVENTION

Clearly, an economical means of adapting product containment sacks for use within aerosol type dispenser is needed. The primary object of this invention is to satisfy that need.

It is another object to provide an economical means of affixing said sack securely in a predetermined location within said dispenser.

It is another object to provide an economical means that enables said sack to be readily filled with a desired product.

It is another object to provide an economical means of pressurizing a sack contained aerosol type dispenser after the valve assembly has been sealingly secured in place.

It is another object to provide an economical pressurizing means that does not necessitate a special plugged hole in the container.

It is another object to provide an economical means for utilizing said product containment sack as a one-way pressure valve allowing introduction but preventing exit of a desired pressurizing agent within the pressure chamber portion of said dispenser.

It is another object to economically achieve all of the previously stated objects within the same aerosol type dispenser.

These and other objects will be seen from the following specification and claims in conjunction with the appended drawings.

PRIOR ART

Valve assemblies on existing aerosol containers are sealingly retained over an annular curled opening in the container lid. To accomplish this, the flanged valve retainer has a raised rim having a curl that overlies the curled container opening. The underside of the valve flange curl is pre-coated with a sealant.

The valve flange extends into the dispenser providing sufficient material for mechanical forming to secure the valve in place once the container has been pressurized. The valve flange portion extending into the container is mechanically forced out radially under the container opening curl causing the valve flange curl to tightly and sealingly seat over the top of the container opening curl. The results have proven quite satisfactory for aerosols not housing a product containment sack. However, if the sealant was applied to the underside of the container lid curl instead of inside the valve flange curl, the sealing feature would be improved. This would allow the mechanically formed flange material to seat against the sealant, the pressure inside the container pushing against the valve flange would assure a reliable seal. The valve flange curl was needed only to prevent the valve assembly from falling into the container prior to pressurization and to protect from an inadvertent unseating of the flange due to an unplanned occurrance. It is also needed to hold the flange in place for forming.

Based on an assumed internal pressure of 70 psi, an annular lid opening of one inch diameter and the mechanically formed diameter of the valve flange extending 1/16 of an inch all around the underside of the lid opening curl, the square inch area of the flange equals 0.97 square inches. The internal pressure against the flange equals 70 psi$\times$0.97 square inches, or 68# force. Actual contact area at the sealant equals 1/25 square inches, compression pressure against the sealant equals 68# divided by 1/25 square inches equals 1700 psi.

In aerosols housing a product containment sack, the valve flange and its curl have proven to be a detriment and, in fact, are not needed.

In the present invention, the internal pressure of the pressurized aerosol container can be utilized to react against the top conically shaped collar portion of the said sack, causing the said sack collar to sealingly seat within the said container lid preventing escape of pressure from within said container.

Generally, lids of aerosol containers are of a torus shape having an annular outturned curl projecting from a central opening. The lid portion immediately below the said curl being flat, then briefly angling out and down before abruptly transforming into a dome shape that extends downwardly and outwardly, eventually transposing into a downwardly and inwardly tapering rim that ultimately forms a channel and seaming lip for attachment to the container side walls.

The points of transposition at the said curl and at the top of the dome on the inside of the lid provide smooth uniform seating surfaces created by natural stretching of the lid material during forming. The conical shape sack collar being supportively held in contact with the said seating surfaces is forced to be sealingly seated by the internal pressure equally distributed on the surface of the said collar.

It will be understood that the drawings are for the purpose of illustration and do not define the scope or limits of the invention.

THE DRAWINGS

FIG. 6 is a partial section illustrating an alternative configuration similar to FIG. 5.

FIG. 7 is an exterior view of the upper collar portion of said sack illustrating an alternative configuration of sack collar retainment feature.

FIG. 8 is a partial section of the upper portion of sack and collar illustrating sack in a collapsed state.

FIG. 9 is a vertical section of a tiltable valve assembly and an alternative configuration of sack collar.

FIG. 10 is a partial section depicting said sack in a reusable dispenser and illustrating an alternative collar configuration.

DETAILED DESCRIPTION OF THE INVENTION

Specific terminology resorted to in describing the illustrative embodiments of the present invention is not intended to be limiting. It is understood that this is for clarity and includes all technical equivalents which function in a similar manner to accomplish a similar purpose or result.

Figure 1:
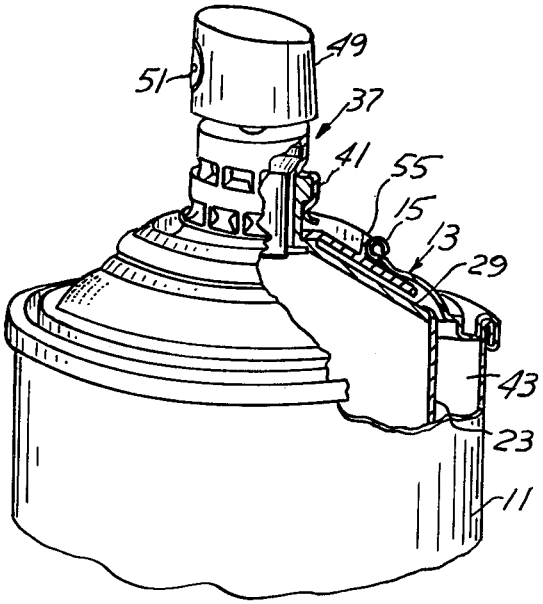
FIG. 1 is an exterior view in perspective of the upper portion of the present dispenser having a broken away portion revealing retainment of a sack and valve assembly.

Referring to the drawing, particularly FIGS. 1 though 4, there is shown fragmentarily in FIG. 1, an aerosol type dispenser or container 11 which has been broken away for convenience and which includes the cover or lid 13 having a central annular lid curl 15 defining an opening at the top of said container. The lid is secured to the container in an conventional manner and is formed so as to include a pair of annular sealing surfaces 17 and 19, FIG. 4, adjacent the dome portion 21.

Figure 2:
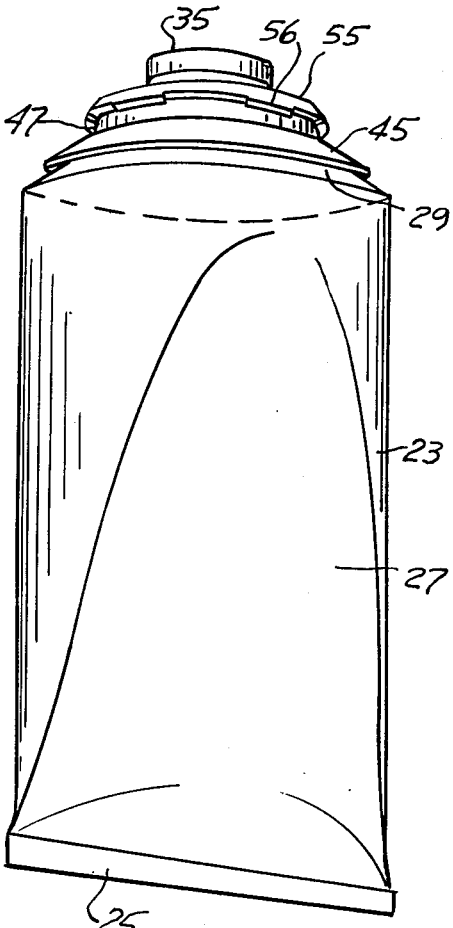
FIG. 2 is an exterior view in perspective of said sack depicting the underside of sack collar retainment feature.

A squeeze tube type collapsible sack 23, FIG. 2, has a transverse closed end 25 and is tapered at its opposite sides at 27 to facilitate collapsing thereof as the material within the sack is dispensed, as shown in FIG. 8.

Said tube has a conventional and integral taper top or primary collar 29 which terminates in the cylindrical neck 31, having a bore 33 and at the top thereof, the annular shoulder 35.

Figure 4:
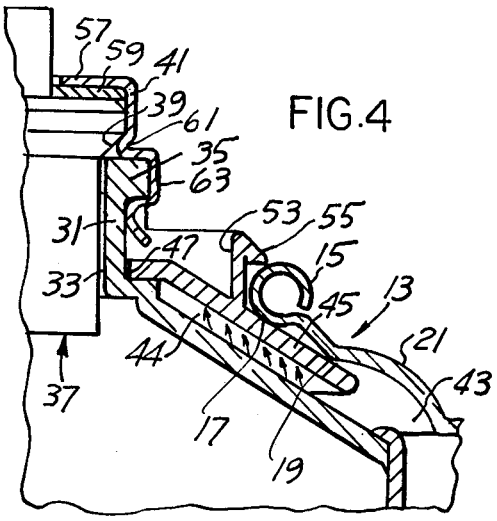
FIG. 4 is a quarter section elaborating the self-sealing feature of said sack collar.

A valve assembly 37 is nested through the bore within neck 31 and is sealingly retained in position upon said neck by crimping of valve assembly retainer 41, FIG. 4, to said annular shoulder 35. Retainer 41 includes apertured top flange 57 engaging gasket 59, is crimped at 61 to tapered shoulder 39, and terminates in annular anchor flange 63.

Thus the valve assembly 37 can be secured to sacks that have been pre-filled with the desired product prior to placement within the aerosol dispenser as well as sacks that are filled after such placement.

Between the wall of container 11 and the sack 23 is an annular pressure chamber 43.

Mounted upon neck 31 or forming an integral part thereof is a secondary annular flexible collar 45 which is inclined downwardly and outwardly and is normally spaced from the tapered top 29 of the sack. This provides a pressure chamber extension 44 so that when pressure chamber 43 has been fully pressurized, such pressure will be applied as shown by the arrows to the undersurface of the collar 45 so that exterior annular surface portions thereof sealingly engage annular seating surfaces 17 and 19 of lid 13.

Collar 45 has an upwardly extending annular flange 53 which terminates in the downturned annular latching rim 55.

Figure 3:
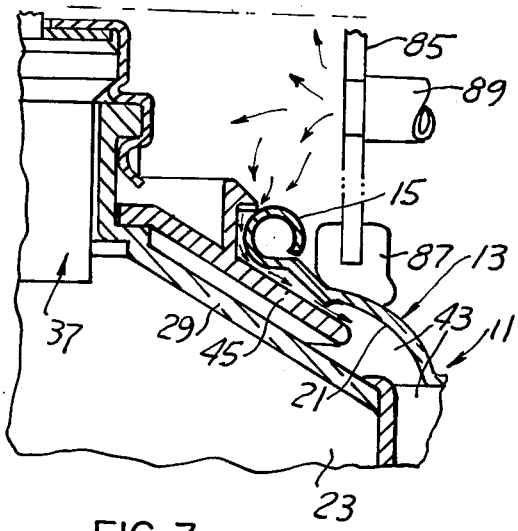
FIG. 3 is a quarter section elaborating pressurizing of said dispenser.

In the assembly of the sack, whether filled or unfilled with material, said sack collar latching rim 55 is snap projected up through the central opening within the lid curl 15 in an interlocking relationship such as will support and suspend the sack within the container 11, as shown in FIGS. 1,3 and 4.

To pressurize the container as shown in FIG. 3, the pressure chamber 85 shown in dash lines having a source of compressed air or other pressurizing agent at 89, encompasses the complete container 11 or at least the curled dome portion 21 of the container cover as by the annular seal 87. The pressure within the container 85 will automatically equalize with the pressure within the pressure chamber 43. Upon removal of said pressure chamber, the sack collar 45 bears against the seating surfaces 17 and 19, and prevents escape of pressure from within the pressure chamber 43, as best illustrated schematically by the arrows in FIG. 4.

An advantage of the annular latching rim 55 as opposed to a series of spaced retainer projections 113, FIG. 7, is the prevention of product overfill from undesired entry into chamber 43. Using such latching rim in annular form produces the potential problem of the possible restriction of the pressurizing agent, FIG. 3, from entering the container since the emulating pressure from within pressure chamber 85 has a tendency to force the latching lip or rim sealingly against the lid curl 15. Such a problem can be resolved by providing depending protrusions on the bottom of the annular surface of the latching lip. The use of the present spaced protrusions 56, FIG. 2, assures that the pressurizing agent within the pressurizing chamber 85 will pass as shown by the arrows between annular latching rim 55 and the annular opening within the lid curl 15.

During pressurizing, the sack collar 45 deflects slightly away from the seating surfaces 17 and 19 upon the inside of the container lid to allow rapid entry passage of the pressurizing agent to chamber 43.

Mass pressurization such as by compressed air, may be accomplished by placing any number of dispensers in their entirety within a compression chamber, such as chamber 85. Upon removal, they will be equally pressurized. A partial chamber is shown in FIG. 3 for illustration.

Premature de-pressurizing of the aerosol type container is prevented by having secondary collar attached to the sack neck of the squeeze tube type of sack. The secondary collar 45 is adapted to keep the lid annular opening at 17 sealed. The taper top or primary collar 29 is an integral part of the sack and may pull away from said secondary collar during dispensing as shown in FIG. 8, enabling all of the product to be dispensed.

Figure 5:
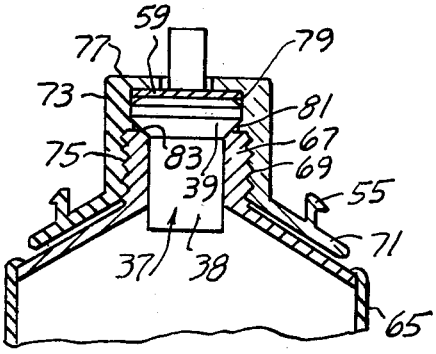
FIG. 5 is a partial modified section of the upper portion of a sack and valve assembly.

A secondary collar is sealingly attached to the primary collar of the sack adjacent the sack neck by integral forming, by heat-welding, by an interlocking detent, or screw threads such as shown in FIGS. 5 and 6.

Alternatively, the primary collar, FIG. 9, could be semi-rigid and have sufficient strength to prevent the collar from pulling away from the lid opening during collapsing of the sack. In such case, a secondary collar is not needed.

It should likewise be noted that for sacks of other shapes, such as the bellows shape, that collapse in a piston-like manner, a secondary collar is not needed.

MODIFICATION

A modified means for securing the valve assembly to collapsible sack 65 is shown in FIG. 5. This can be accomplished by the utilization of the collar 71, as the valve retainer, to sealingly secure valve housing 38 with associated valve components within the neck 67 of the sack. Said collar is adapted for threaded engagement with said sack neck exterior thread 69.

The downwardly tapered flexible collar 71 with the above described latching rim 55 includes a retainment collar 73 with internal thread 75, and apertured top 77 with bore 79 to receive the valve housing 38 and associated valve components. Internal annular bead 81 retainingly engages the tapered shoulder 39 of the valve housing. Sealing is accomplished by engagement of the upper portion of the sack neck as at 83 in registry with the tapered shoulder 39.

The secondary collar 71 also is the retainer of valve assembly 37. The central opening within the top 77 allows free movement of the valve stem, as a part of said valve assembly.

The sack neck 67, when screwed into place, sealingly bears against the valve housing shoulder 39 as at 83. This causes the top of the valve housing to sealingly bear against the valve stem gasket 59 within the closure 73.

The construction shown in FIG. 5 is particularly suited for use with pre-filled sacks for use in a reusable container. Also it allows for use of conventional unmodified squeeze tube sacks.

MODIFICATION

A modification is shown in FIG. 6 wherein, collapsible sack 91 has neck 93 receiving the valve assembly 37. Upon the exterior of said neck is an annular groove 95 which cooperatively and sealingly receives internal annular bead 101 within the secondary flexible neck 99 upon secondary collar 97.

The secondary neck 99 terminates in annular shoulder or bead 103 over which the valve assembly retainer 41 is crimped, as at 105.

An intermediate annular crimp 107 formed within the valve assembly retainer supportably and retainingly engages the tapered shoulder 39 of the valve housing.

The means of assembling the valve assembly within the collapsible tube and employing the valve assembly retainer 41 further functions to anchor the valve assembly within the retainer 41 and for securing the retainer to the secondary neck 99.

This assembly is equally suitable for pre-filled sacks as well as sacks filled after being housed within the aerosol dispenser.

MODIFICATION

A modified retainment feature for the sack collar is shown in FIG. 7. Here the collapsible tube 109, fragmentarily shown, includes the tapered top 29 which terminates in the neck 31 and at the top, the assembly shoulder 35.

The modified flexible collar 110 is sealingly mounted over or projects from neck 31 as a part thereof and extends downwardly in spaced relationship to tapered top 29 in the same manner as shown in FIG. 4.

Arranged in a circle upon the collar 110 are a series of spaced upright bosses 111 which terminate at their upper ends in the outwardly extending retainer projections 113.

These are adapted to snap fasten up through and within the lid curl 15 of lid 13 in the same manner as shown in FIG. 4 and wherein, the outer surfaces of collar 110 sealingly engage the annular seating surfaces 17 and 19 as in FIG. 4.

MODIFICATION

The modification shown in FIG. 9 is particularly suited for sacks 23 containing paste-like products. Here a semi-rigid sack collar 115 forms a part of sack 23 having a neck 117 providing a pocket to permit unseating of the valve 127 of a conventional tiltable valve assembly 119. Formed as a part of the collar 115 is a retainment latching rim 55 the same as above described with respect to FIG. 4. Said rim allows snap-in assembly and suspension within the opening within the lid curl 15. Pressurization, therefore, within chamber 43 may be achieved in the same manner as above described with respect to FIGS. 3 and 4. Valve retainer 121 has an internal annular flange 123 adapted to be supportably received within the assembly groove 125 of the tiltable valve assembly with the valve 127 normally seated adjacent the undersurface of the retainer. The valve retainer has an annular crimp at 129 for securing over the annular shoulder 131 at the upper end of the sack neck. This sack can be filled after retainment or prefilled.

MODIFICATION

A modification is shown in FIG. 10 where an aerosol type container 133 has an outwardly grooved top flange 135 which mounts therein the threaded ring 137. Lid 139 at the upper end has an annular assembly bead 141 corresponding to the assembly curl 15, FIG. 4, and a pair of annular internal sealing surfaces 145 similar to sealing surfaces 17 and 19 above described with respect to FIG. 4. Depending rim 143 is internally threaded and is mounted over the ring 137 for removably securing the lid 139 to said container or dispenser.

The modified collapsible tube 147 has an apertured neck 149 adapted to receive valve assembly 37 and also has an annular bead 151. Flexible collar 153, similar to the arrangement of the collar 45, FIG. 4, is inclined downwardly and outwardly and spaced from the tube top wall.

A suitable gasket 155 is interposed between lid 139 and the top of container 133 to effect a seal therebetween. Collar 153 terminates in a secondary neck 157 having an annular groove 159 which supportably receives the bead 151 upon the sack neck.

The secondary neck 157 has an external thread 161 over which is threaded the valve retainer 163 which cooperatively and sealingly engages the valve assembly. The valve retainer includes an annular flange 165 which is internally threaded at 167 for threading over secondary neck 157 completing the assembly.

The securing of valve assembly 37 is substantially the same as above described with respect to FIG. 5.

Container 133 is a modification of the conventional container to, thus, provide a reusable dispenser. A pressurizing valve may be placed as desired within the container or the lid, or pressurizing can be achieved in the same manner as above described with respect to FIG. 3.

Having described my invention, reference should now be had to the following claims.

I claim:

1. In an aerosol type container or dispenser having an apertured lid and a pressure chamber, a collapsible sack containing material to be dispensed nested within said chamber and having a neck projected through and suspended from said lid;

and a valve assembly nested, sealed and retained within said neck and projecting therefrom, the mounting of said neck within said lid including an annular flexible collar upon said neck spaced from said sack;

and an annular retainer projection upon said collar retainingly extending through and interlocked with an outer portion of said lid, said collar yieldably and sealingly bearing against the inside of said lid in a relationship that upon application of a pressurizing agent to said container, said collar is displaced inwardly permitting inward passage of the agent through the lid aperture and into said pressure chamber, said collar upon interruption of the application of the pressurizing agent automatically returning to sealing engagement with said lid under the action of said agent in said pressure chamber and the flexibility of the collar preventing outward passage of the pressurizing agent.

2. In the aerosol container of claim 1, the annular space between said collar and sack being in communication with said pressure chamber, whereby when pressurized, the internal pressure acts against said collar sealing the same against said lid.

3. In the aerosol container of claim 1, said lid including an annular lid curl, there being annular seating surfaces upon the interior of said curl and said lid, said collar operatively engaging said seating surfaces throughout 360 degrees.

4. In the aerosol container of claim 1, said retainer projection including an annular flange, and a series of spaced outwardly extending projections spaced from said collar, with said lid curl yieldably retained between said collar and projections.

5. In the aerosol type container of claim 4, said collar when sealed within a pressurizing chamber, being adapted to flex inwardly communicating said pressurizing chamber with said container pressure chamber until pressures in said chambers are equalized, said collar flexibly returning to sealing engagement with said lid, and held there by the pressure in said pressure chamber, maintaining a constant pressurization of said pressure chamber.

6. In the aerosol container of claim 1, said collar when sealed within a pressurizing chamber being adapted to flex inwardly communicating said pressurizing chamber with the container pressure chamber until pressures in said chambers are equalized, said collar flexibly returning to sealing engagement with said lid, and held there by the pressure in said pressure chamber, maintaining a constant pressurization of said pressure chamber.

7. In the aerosol type container of claim 1, said collar being an integral part of said neck and sack.

8. In the aerosol type container of claim 1, said lid including an annular lid curl, said collar being inclined downwardly and outwardly; said retainer projection adapted to yieldably snap over the lid curl.

9. In the aerosol type container of claim 1, said neck having an annular shoulder, the retaining of said valve assembly relative to said neck including a formed retainer enclosing and retainingly engaging and sealing said valve assembly and interlocked over said shoulder.

10. In the aerosol type container of claim 9, said valve assembly including a body with a tapered shoulder, said retainer having an annular crimp supportably engaging said tapered shoulder.

11. In the aerosol type container of claim 1, said sack neck having an external thread;

a secondary neck connected to said collar and having an interior thread, mounted over said sack neck;

the retaining of said valve assembly including an apertured retainer upon said secondary neck enclosing and retainingly engaging said valve assembly, said valve assembly being sealed within the top of said sack neck.

12. In the aerosol type container of claim 1, a secondary neck connected to said collar and surrounding and affixed to said sack neck;

the retaining of said valve assembly including an apertured retainer upon said sedondary neck enclosing and retainingly engaging said valve assembly, said valve assembly being sealed within the top of said sack neck, said valve assembly being sealed with respect to said retainer.

13. In the aerosol type container of claim 12, the affixing of said secondary neck to said neck including an interlocking annular groove and a bead upon said secondary neck and sack neck respectively.

14. In the aerosol type container of claim 12, a shoulder upon said secondary neck, said retainer having a crimped portion retainingly engaging said shoulder.

15. In the aerosol type dispenser of claim 1, said lid including an annular lid curl;

said retainer projection including a series of upright spaced bosses in a circle upon said collar;

and an outwardly extending projection on each boss spaced from said collar, with said lid curl yieldably retained between said collar and projections.

16. In the aerosol type container of claim 1, a secondary neck connected to said collar surrounding and affixed to said sack neck;

the retaining of said valve assembly including an apertured retainer upon said secondary neck and secured thereto, enclosing and retainingly engaging said valve assembly, said valve assembly being sealed within the top of said secondary neck, said retainer sealingly engaging said valve assembly.

17. In the aerosol type container of claim 16, the securing of said retainer to said secondary neck including an annular interiorly threaded flange, said secondary neck being exteriorly threaded to cooperatively receive said flange.

18. In the aerosol type container of claim 16, the securing of said secondary neck to said sack neck including an interlocking bead and annular groove formed upon said secondary neck and sack neck respectively.

19. In the aerosol type container of claim 1, said container mounting a threaded ring at one end thereof;

said lid having a depended annular interiorly threaded rim threaded over said ring;

and sealing means between said lid and container.

20. In the aerosol type container of claim 1 said neck merging with said collar providing a chamber;

said valve assembly including a tilt-type dispenser with a valve element normally seated within said chamber, and a retainer supportably mounting said valve assembly and crimped over the upper end of said collar, said valve seating adjacent said retainer.

21. In the aerosol type container of claim 20, the securing of said retainer to said collar including a shoulder on said collar over which said retainer is crimped.

22. In an aerosol type container or dispenser having an apertured lid and a pressure chamber;

a collapsible sack containing material to be dispensed nested within said chamber and having a neck projected through and supported from said lid;

(and) a valve assembly nested and sealed and retained within said neck and projecting therefrom, the mounting of said neck within said lid including an annular collar forming the upper portion of said neck as a part thereof, and a series of spaced retainer projections upon said collar retainingly extending through and interlocked with an outer portion of said lid, said (neck) collar yieldably and sealingly bearing against (engaging) the inside of said lid in a relationship that upon application of a pressurizing agent to said container, said collar is displaced inwardly permitting inward passage of the agent through the lid aperture and into said pressure chamber, said collar upon interruption of the application of the pressurizing agent automatically returning to sealing engagement with said lid under the action of said agent in said pressure chamber and the flexibility of the collar preventing outward passage of the pressurizing agent.

* * * * *